US005208076A

United States Patent [19]

Wood

[11] Patent Number: 5,208,076

[45] Date of Patent: May 4, 1993

[54] FULL COVERAGE PRINTING

[75] Inventor: Bill R. Wood, Simpsonville, S.C.

[73] Assignee: W. R. Grace & Co.-Conn., Duncan, S.C.

[21] Appl. No.: 751,498

[22] Filed: Aug. 29, 1991

[51] Int. Cl.[5] ..... B05D 1/28

[52] U.S. Cl. ..... 427/428; 101/483; 101/DIG. 49

[58] Field of Search ..... 427/428; 118/46; 101/DIG. 49, 483

[56] References Cited

U.S. PATENT DOCUMENTS 2,380,047 7/1945 Hyman ..... 427/428 X 4,786,532 11/1988 Brown et al. ..... 427/428

OTHER PUBLICATIONS

Flexography: Principles and Practices, 4th Ed., Ronkonkoma, N.Y., Foundation of Flexographic Technical Association, 1991, pp. 16, 17, and 23.

*Primary Examiner*—Evan Lawrence

*Attorney, Agent, or Firm*—William D. Lee, Jr.; Mark B. Quatt; Leigh P. Gregory

[57] ABSTRACT

A method for printing a web along the entire transverse width of the web, while avoiding ink build up on an impression cylinder, comprises passing the web between a printing cylinder and an anilox roll, and applying ink from the anilox roll to the web such that the ink covers substantially the entire width of an outer surface of the web.

3 Claims, 1 Drawing Sheet

FULL COVERAGE PRINTING

FIELD OF THE INVENTION

This invention relates generally to flexographic printing, and more particularly to a method for printing a web across the full width of the web.

BACKGROUND OF THE INVENTION

In the art of flexographic printing, and in particular the use of an impression cylinder, a web passes between a printing cylinder and an impression cylinder. The impression cylinder is typically a smooth metal cylinder, and it supports the web against the printing cylinder. The printing cylinder is also typically a smooth metal cylinder, and carries one or more rubber or elastomeric printing plates. These plates pick up rapid drying fluid ink from an anilox (ink metering) roll, and deposit it on surface of the web in contact with the printing cylinder. The anilox roll in turn transfers ink from a fountain roll, or an open or closed doctor blade system, in communication with a source of ink.

Flexographic techniques are discussed in *Flexography Principles and Practices,* second edition, copyright 1970, published by the Flexographic Technical Association, Inc.; and *Flexographic Printing,* copyright 1958, published by F.E. Boughton.

For certain market applications, it is sometimes desirable to print the surfaces of a web, especially a thermoplastic web in rollstock form, or the outer surfaces of a flattened tubular web, with a continuous, uniform background color. For example, to create a smoked appearance for certain food packaging applications, a flattened tubing will be printed on the outer surfaces of the tubing using a flexographic process as described above. The printing cylinder will in this case be covered with a continuous rubber or elastomeric covering rather than discrete, spaced rubber or elastomeric printing plates. The web to be printed, e.g. with a dark brown ink, will be drawn between the impression cylinder and the printing cylinder. The ink will then be deposited on the web in the manner described above.

It is desirable from an aesthetic standpoint that the ink cover the entire outer surfaces of the tube, i.e. extend across the entire transverse width, as well as length, of the tube. To assure this complete transverse coverage, the printing cylinder is inked along a greater transverse width than the width of the web to be printed. This assures printing of the lateral extremities of the web. However, this also results in the undesirable build up of excess ink on the impression cylinder, along and beyond the two lateral edges of the web. It is costly, difficult, and time consuming to remove this build up of excess ink from the impression cylinder.

An alternative to avoid this build up of ink is to ink the printing cylinder along a transverse width somewhat less than the width of the web to be printed. However, this approach results in a rollstock or flattened tube which is printed along a central portion thereof, but clear (in the case of clear thermoplastic rollstock or tubing) along its lateral (transverse) edges. This results in a less attractive web for some of the end uses for which the web is intended.

The inventor has discovered a method, described herein, for obtaining full transverse ink coverage of a web without significant ink build up on the impression cylinder.

The term "web" is used herein to include rollstock or flattened tubing, to be printed on one or both sides, and includes paper; thermoplastic films, sheets, or laminates; and other materials susceptible to coloration or printing in a flexographic process or a process as described herein.

The term "printed" is used herein to indicate the deposition of an ink on all or part of the surface of a web. This includes the deposition of a single ink in a uniform, continuous manner on the web to effect a uniformly colored web (extending along all or some of the entire transverse width of the web) e.g. as a colored "coating" to the web. This also includes the use of printing plates to impart singly or in sequence a monochromatic or multicolored graphic design on the web, e.g. as a trade dress or design e.g. to identify a particular brand.

It is an object of the invention to obtain full transverse coverage of a web without significant ink build up on the impression cylinder.

The foregoing object is accomplished by the present invention which is summarized below.

SUMMARY OF THE INVENTION

In one aspect of the present invention, a method for printing a web along substantially the entire width of the web comprises passing the web between a printing cylinder and an anilox roll; and applying ink from the anilox roll to the web such that the ink covers substantially the entire width of an outer surface of the web.

DESCRIPTION OF THE DRAWINGS

In the drawings which are appended hereto and made a part of this disclosure.

BEST MODE OF CARRYING OUT THE INVENTION

Figure 1:
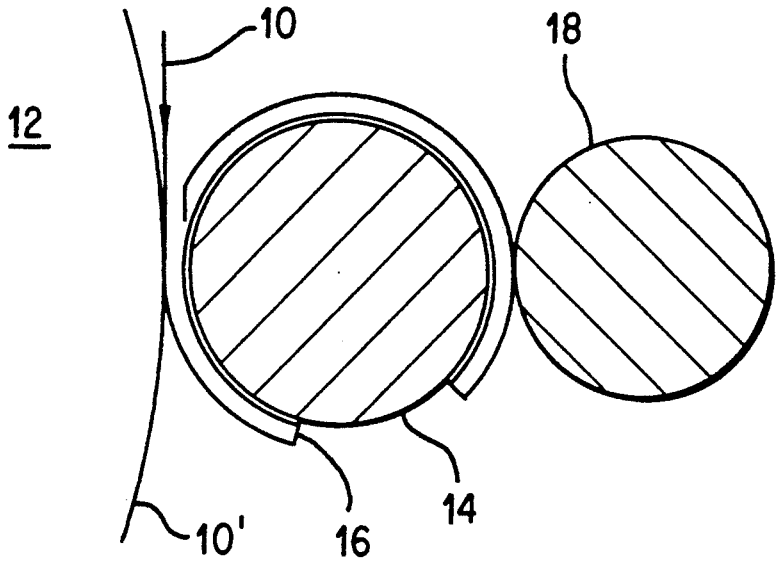
FIG. 1 is a schematic representation of a standard process for printing a web in a flexographic operation.

Turning first to FIG. 1, a standard process for printing a web is schematically illustrated. Web 10 passes between a printing cylinder 14 and a central impression cylinder (sometimes known as a bull drum) 12. Ink from anilox roll 18 is transferred to the printing plate 16 mounted with suitable backing on printing cylinder 14. The printing cylinder 14 is gear driven, rotates in the opposite direction from impression cylinder 12, and meters a coating of ink on web 10. If the web 10 is to be completely covered along all or part of its entire transverse width by the ink, a smooth continuous rubber covering (not shown) would be used in place of discrete printing plates 16. To effect total coverage of the web, such a rubber covering would carry ink along a width greater than that of the web to be printed. As pointed out above, this results in the undesirable buildup of ink along portions of the impression cylinder 12 where it contacts the inked rubber covering of the printing cylinder 14 outside the lateral edges of the web 10. The T-M alternative, inking the rubber covering of the printing cylinder 14 along a width less than the width of the web 10 to be printed, is also undesirable because less than all of the transverse width of the web is printed. This is aesthetically and commercially undesireable in some end use applications.

Figure 2:
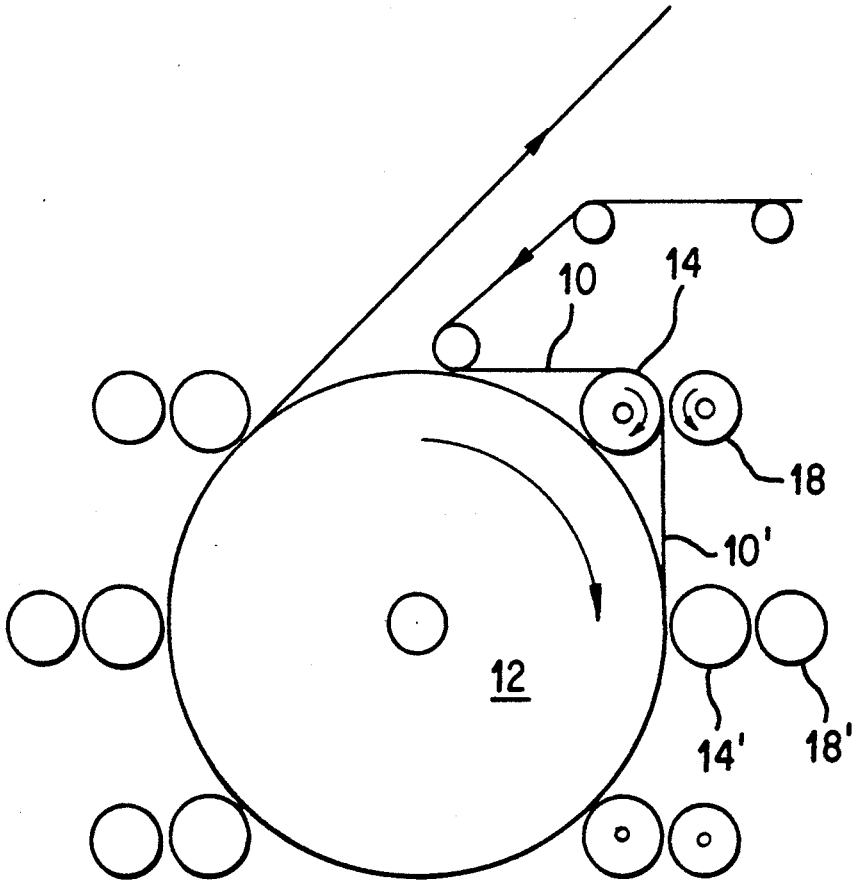
FIG. 2 is a schematic representation of the inventive process for printing a web along substantially the entire width thereof.

The inventive solution to these problems is illustrated in FIG. 2. The web 10 passes between a rubber covered printing cylinder 14 and anilox roll 18. Note that the printing cylinder is free-wheeling, and is illustrated as rotating in the same direction as the impression cylinder 12. Thus, the web 10 does not contact the central impression cylinder 12 during this part of the printing process. The web is completely printed along its transverse width, on one outer surface of the web, as it passes between the printing cylinder 14 and an anilox roll 18. This is accomplished because the degree of contact between the anilox roll 18 and the web 10 can be very precisely controlled. For example, a web 10 of typically 0.005 inches thickness can be inked along its entire lateral width without significant build up of ink along the outer portions of the rubber covered printing cylinder. This level of precision is not available in the method previously described, where the web is passed between the printing cylinder and the impression cylinder. The ink, which is a rapid drying fluid ink, is essentially dried before the now printed web 10' comes into contact with impression cylinder 12. This avoids ink build up on the impression cylinder, while still providing edge-to-edge, full transverse width printing of the web. If additional printing of artwork is desired, then standard printing stations such as those shown for printing cylinder 14' and anilox roll 18' can be used.

The invention includes a method for printing a web comprising passing the web between a printing cylinder and an anilox roll; and applying ink from the anilox roll to the web, wherein the printing cylinder and anilox roll are part of a central cylinder press flexographic printing system. The method of the invention also includes a method for printing a web comprising passing the web between a printing cylinder and an anilox roll; and applying ink from the anilox roll to the web, wherein the printing cylinder is covered by a continuous rubber or elastomeric covering.

Having thus described our invention, we claim:

1. A method for printing a web comprising:

(a) passing the web between a printing cylinder and an anilox roll; and (b) applying ink from the anilox roll to the web; wherein the printing cylinder is covered by a continuous rubber or elastomeric covering; and wherein the ink is applied from the anilox roll such that the ink covers substantially the entire lateral width of an outer surface of the web.

2. The method of claim 1 wherein the printing cylinder and anilox roll are part of a flexographic printing system.

3. The method of claim 1 wherein the printing cylinder and anilox roll are part of a central cylinder press flexographic printing system.

* * * * *